US006273637B1

(12) United States Patent
Peterson

(10) Patent No.: US 6,273,637 B1
(45) Date of Patent: Aug. 14, 2001

(54) DUAL WHEEL TRENCH COMPACTOR

(76) Inventor: Randell D. Peterson, Rte. 1, Box 86, Ulysses, NE (US) 68669

( * ) Notice: Subject to any disclaimer, the term of this patent is extended or adjusted under 35 U.S.C. 154(b) by 0 days.

(21) Appl. No.: 09/296,901

(22) Filed: Apr. 22, 1999

(51) Int. Cl.[7] ..... E01C 19/26
(52) U.S. Cl. ..... 404/127; 404/122; 37/142.5
(58) Field of Search ..... 404/91, 103, 122, 404/127, 128, 133.05; 405/271, 179; 37/142.5

(56) References Cited

U.S. PATENT DOCUMENTS

| | | | | |
|---|---|---|---|---|
| D. 305,337 | | 1/1990 | Plummer | D15/28 |
| 975,457 | * | 11/1910 | Ransome | 37/142.5 |
| 2,891,335 | * | 6/1959 | Linneman | 37/146 |
| 3,283,841 | * | 11/1966 | Davis | 180/14 |
| 3,471,953 | * | 10/1969 | Wyatt | 37/142.5 |
| 3,908,292 | | 9/1975 | Harris | 37/142.5 |
| 3,961,856 | * | 6/1976 | Degenhart | 404/133 |
| 4,127,351 | * | 11/1978 | Vural | 404/72 |
| 4,539,765 | | 9/1985 | Reece | 37/142.5 |
| 4,579,071 | | 4/1986 | Johnson | 111/85 |
| 4,723,870 | | 2/1988 | Martinez | 404/121 |
| 4,782,606 | | 11/1988 | Surface | 37/117.5 |
| 4,911,248 | * | 3/1990 | Schrepfer | 172/464 |
| 4,913,581 | | 4/1990 | Weiler | 404/117 |
| 5,088,855 | * | 2/1992 | Giliberti | 404/103 |
| 5,114,269 | * | 5/1992 | Shepherd | 404/122 |
| 5,499,685 | * | 3/1996 | Downing, Jr. | 172/699 |
| 5,526,590 | * | 6/1996 | Palm et al. | 37/142.5 |

* cited by examiner

*Primary Examiner*—Thomas B. Will
*Assistant Examiner*—Kristine Markovich
(74) *Attorney, Agent, or Firm*—Zarley, McKee, Thomte, Voorhees & Sease; Dennis L. Thomte

(57) ABSTRACT

A compactor including a forward and rearward compaction wheel each rotatably supported on a support arm and pivotally connected to a main frame. The forward compaction wheel is pivoted to a position aligned forwardly of and positioned below the rearward compaction wheel when in an operating position. A pair of diverter panels are connected to the frame and extend longitudinally on opposing sides of the rearward compactor wheel to divert fill dirt towards the compactor wheels. Each diverter panel has a diverter wing pivotally connected thereto with the diverter wings diverging outwardly and forwardly. The diverter wings are pivotally connected at a point of the forward compaction wheel and proximal thereto. The diverter panels are preferably parallel to one another and extend rearwardly beyond the rearward compaction wheel. The diverter wings preferably extend forwardly beyond the forward compaction wheel.

10 Claims, 2 Drawing Sheets

DUAL WHEEL TRENCH COMPACTOR

TECHNICAL FIELD

The present invention relates generally to soil compactors, and more particularly to an improved soil compactor especially suited for narrow and deep trenches.

BACKGROUND OF THE INVENTION

The installation of fiber-optic cable has become quite common in both residential districts and rural areas. The typical installation utilizes a trencher apparatus to form a trench in excess of four feet deep and approximately six inches in width, while fiber optic cable is dispensed behind the trencher at the bottom of the trench.

The main problem with conventional installations of cable in the bottom of this narrow, deep trench is the replacement of soil in the trench. Typically, the soil piled to the sides of the trench will be pushed into the trench with a backhoe or the like. If this backfilled earth is not compacted sufficiently, a mound of soil will remain over the trench or the soil will later settle and form a depression along the line of the underground installation. Such a depression causes water to stand along the trench and can thereby increase the possibility of damage to the cable at the bottom of the trench as well as vehicles travelling along the trench. Further, people and animals may be injured if they come into contact with the depression.

One method for compacting the soil within the trench utilizes a compacting roller centrally supported on the bucket or scoop of a loader machine. In use, the machine straddles the trench and the roller is moved fore and aft within the trench to compact the soil. The roller at the front end of the loader, and the manipulation of the loader weight on the roller, makes it difficult to steer the machine and follow the trench line and requires large amounts of time to conduct the fore and aft movement of the roller which, in turn, results in poor compaction of the trench.

SUMMARY OF THE INVENTION

It is therefore a general object of the present invention to provide an improved compactor for trenches and especially narrow and deep trenches.

Another object of the present invention is to provide a dual wheel compactor for compacting backfill dirt within a trench at two different levels to provide a uniform compacting from the trench bottom to the ground level.

Still another object is to provide a dual wheel compactor with vertically adjustable compactor wheels for the compaction of trenches of various depths.

Still a further object of the present invention is to provide a dual wheel compactor which will compact dirt to the finished grade level on a single pass along the trench.

Yet another object of the invention is to provide a dual wheel compactor which is adapted to be used on large or small trenching machines.

Yet another object is to provide a dual wheel compactor which is simple to operate and economical to manufacture.

These and other objects of the present invention will be apparent to those skilled in the art.

The compactor of the present invention includes a forward and rearward compaction wheel each rotatably supported on a support arm and pivotally connected to a main frame. The forward compaction wheel is pivoted to a position aligned forwardly of and positioned below the rearward compaction wheel when in an operating position. A pair of diverter panels are connected to the frame and extend longitudinally on opposing sides of the rearward compactor wheel to divert fill dirt towards the compactor wheel. Each diverter panel has a diverter wing pivotally connected thereto with the diverter wings diverging outwardly from one another. The diverter wings are pivotally connected at a point rearwardly of the forward compaction wheel and proximal thereto. The diverter panels are preferably parallel to one another and extend rearwardly beyond the rearward compaction wheel. The diverter wings preferably extend forwardly beyond the forward compaction wheel.

DESCRIPTION OF THE PREFERRED EMBODIMENT

Figure 1:
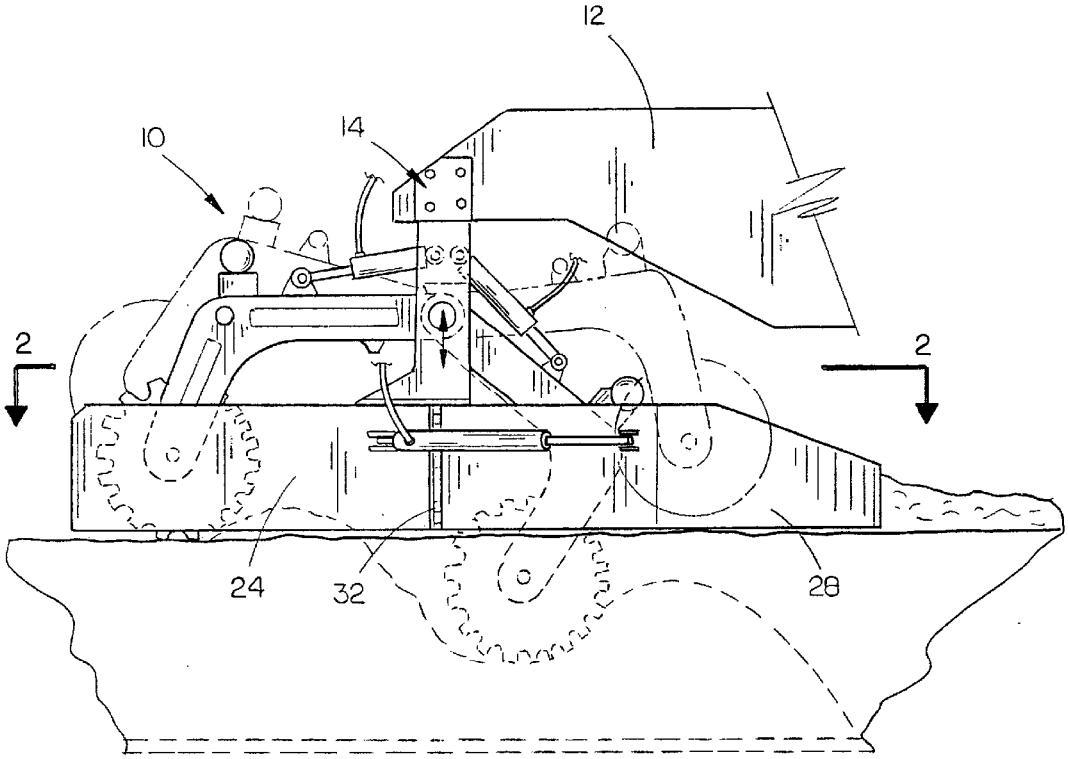
FIG. 1 is a side elevational view of the compactor of the present invention.

Referring now to the drawings, in which similar or corresponding parts are identified with the same reference numeral, and more particularly to FIG. 1, the dual wheel compactor of the present invention is designated generally at 10 and is shown mounted on a support arm 12 extending from a tractor or other towing vehicle (not shown). Preferably, support arm 12 is of a type which may be raised and lowered so as to raise compactor 10 off the ground for transport to various locations.

A frame 14 is mounted to the rearward end of support arm 12 and includes a pair of spaced-apart vertical side members 16 and 18, respectively, connected at their lower ends by a horizontal plate 20. A pair of dirt diverter panels 22 and 24 depend from plate 20 and extend rearwardly therefrom. Diverter panels 22 and 24 are vertically oriented and preferably parallel to one another. A pair of dirt diverter wings 26 and 28 are pivotally connected to the forward ends of diverter panels 22 and 24, respectively, at hinges 30 and 32, respectively. Hinges 30 and 32 are oriented vertically to permit pivotal movement of diverter wings 26 and 28, as shown by arrows 34, to increase or decrease the angle of divergence between diverter wings 26 and 28.

A hydraulic cylinder 36 is pivotally connected at a rearward end 36*a* to diverter panel 22 and has its cylinder rod 38 pivotally connected to diverter wing 26. A hydraulic hose 40 is operably connected to cylinder 36 to extend and retract rod arm 38 and thereby selectively pivot diverter wing 26 as shown by arrow 34. A similar cylinder 36' is pivotally connected at a rearward end 36*a*' between diverter panel 24 and diverter wing 28 such that hydraulic pressure provided by hydraulic hose 40' extends and retracts cylinder rod 38' to pivot diverter wing 28.

Figure 2:
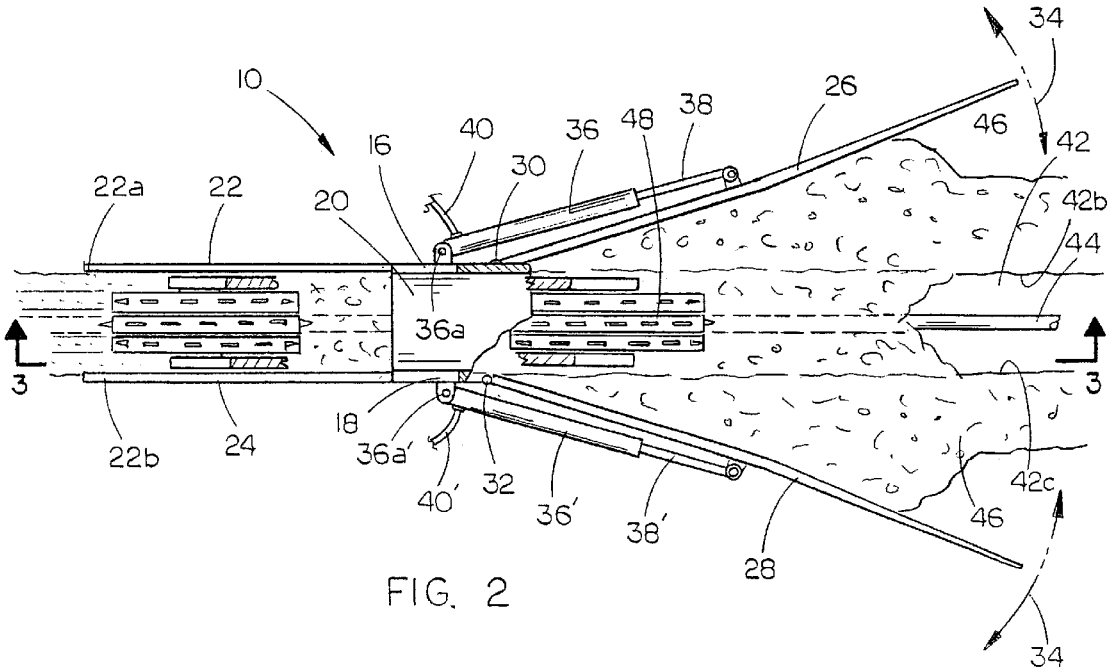
FIG. 2 is a sectional view taken at lines 2—2 in FIG. 1, looking down at the trench being filled using the compactor of the present invention.
Figure 3:
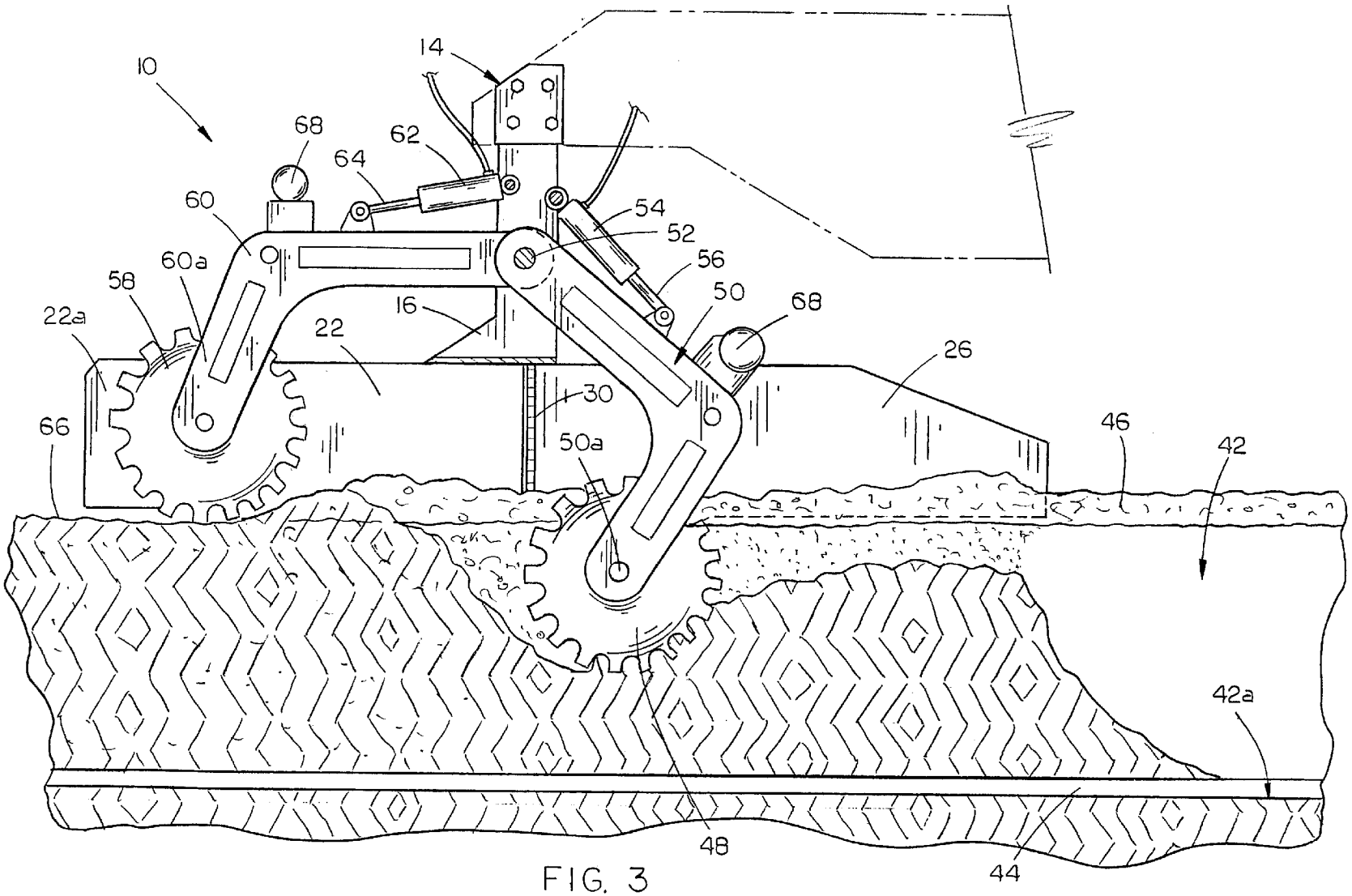
FIG. 3 is a sectional view taken at lines 3—3 in FIG. 2.

Referring now to FIGS. 2 and 3, a deep, narrow trench 42 has been cut by a conventional trencher and a cable 44 is shown laid on the bottom 42*a* of the trench. Fill dirt 46 which has been removed from trench 42 during the trenching operation is filed along both sides of the trench.

A forward compactor wheel 48 is rotatably mounted on the lower end 50*a* of an L-shaped support arm 50. The upper end of support arm 50 is pivotally mounted to a main axle 52 extending horizontally between side members 16 and 18.

Axle 52 is oriented perpendicularly to the longitudinal axis of diverter panels 22 and 24 with support arm 50 and forward compactor wheel 48 vertically movable between diverter wings 26 and 28 by the pivoting action of support arm 50. A cylinder 54 is pivotally connected at a rearward end to frame 14 above axle 52. The cylinder rod 56 of cylinder 54 is pivotally connected to support arm 50 forwardly of axle 52, such that extension or retraction of cylinder 54 will cause support arm 50 to selectively raise and lower compactor wheel 48.

A rearward compactor wheel 58 is rotatably mounted on the lower end 60*a* of a second L-shaped support arm 60. The forward end of support arm 60 is pivotally mounted to axle 52 to permit rearward compactor wheel 58 to be selectively raised and lowered between diverter panels 22 and 24. A cylinder 62 is pivotally connected at a forward end to frame 14 at a point above axle 52. Cylinder rod 64 of cylinder 62 is pivotally connected to support arm 60 rearwardly of axle 52. Actuation of cylinder 62 to extend or retract extensible arm 64 thereby selectively raises and lowers rearward compactor wheel 58.

A conventional vibrator motor 68 is rigidly mounted to each of support arms 50 and 60 such that operation of vibrators 68 will vibrate arms 50 and 60 and thereby vibrate compactor wheels 48 and 58 to enhance the compaction capabilities thereof.

In operation, compactor 10 may be towed directly behind the cable laying machine or towed behind a separate vehicle. As shown in FIG. 2, compactor 10 is aligned over trench 42 with diverter panels 22 and 24 generally aligned with the side walls 42*b* and 42*c* of trench 42. Diverter wings 26 and 28 are then pivoted to the desired divergent angle so as to divert the mounds of fill dirt 46 on each side of trench 42 gradually towards the trench as the compactor is moved forwardly.

As shown in FIGS. 2 and 3, forward compactor wheel 48 is mounted on compactor 10 forwardly of the rearward ends of diverter wings 26 and 28 such that fill dirt 46 continues to be diverted into the trench on top of and rearwardly of forward compactor wheel 48.

The desired vertical height of forward compactor wheel 48 above the trench bottom 42*a* may be selectively adjusted by actuating cylinder 54 to pivot forward support arm 50. For a conventional trench approximately fifty-two inches deep, forward compactor wheel 48 is preferably located approximately thirty-six inches below the finish grade line 66, or approximately half the distance from the bottom of trench 42.

The rearward compactor wheel is mounted on rearward support arm 60 and located between the rearward ends 22*a* and 22*b* of diverter panels 22 and 24. Cylinder 62 is actuated so as to locate rearward compactor wheel 58 with the lowermost compacting surface located at the finish grade line 66. As compactor 10 is moved forwardly, diverter wings 26 and 28 will force a portion of fill dirt 46 into trench 42 forwardly of forward compactor wheel 48. Forward compactor wheel 48 will compact the loose fill dirt in the lower half of trench 42. Because of the location of forward compactor wheel 48, the rearward ends of diverter wings 26 and 28, and diverter panels 22 and 24, will force the remaining fill dirt 46 on top of and rearwardly of forward compactor wheel 48, in front of rearward compactor wheel 58. The operation of vibrator 68 enhances the compaction capabilities of compactor wheels 48 and 58 to leave a completely filled-in and compacted trench with a surface at the desired finish grade line 66.

Whereas the invention has been shown and described in connection with the preferred embodiment thereof, many modifications, substitutions and additions may be made which are within the intended broad scope of the appended claims.

I claim:

1. A compactor for filling a trench with fill dirt and compacting the fill dirt in the trench to a finish grade line, comprising:

a main frame;

a forward support arm having first and second ends;

a forward compactor wheel rotatably mounted to said first end of said forward support arm;

said second end of said forward support arm being directly secured to said main frame;

a rearward support arm having first and second ends;

a rearward compactor wheel rotatably mounted to said first end of said rearward support arm;

said second end of said rearward support arm being directly connected to said main frame;

said rearward compactor wheel positioned rearwardly and vertically above said forward compactor wheel and being longitudinally aligned therewith;

said forward and rearward compactor wheels having parallel rotational axes;

upstanding first and second horizontally spaced-apart diverter panels connected to said main frame positioned on lateral sides of said rearward compactor wheel;

said first and second diverter panels having rearward and forward ends;

upstanding first and second diverter wings having rearward and forward ends;

said rearward ends of said first and second diverter wings being secured to said first and second diverter panels adjacent the forwards ends thereof, respectively;

said first and second diverter wings extending forwardly and outwardly from the rearward ends thereof to divert fill dirt laterally towards said compactor wheel;

said forward ends of said first and second diverter wings being positioned forwardly of said forward compactor wheels.

2. The compactor of claim 1 wherein said forward support arm is pivotally connected to said main frame about a generally horizontal axis parallel to the rotational axis of said forward compaction wheel, for pivotal movement within a vertical plane, and further comprising means connected between said forward support arm and said main frame for selectively pivoting said forward support arm to selectively raise and lower said forward compaction wheel.

3. The compactor of claim 2 wherein said rearward support arm is pivotally connected to said main frame about a generally horizontal axis parallel to the rotational axis of said rearward compaction wheel, for pivotal movement within a vertical plane, and further comprising means connected between said rearward support arm and said frame for selectively pivoting said rearward support arm to selectively raise and lower said rearward compaction wheel.

4. The compactor of claim 1, wherein said rearward support arm is pivotally connected to said main frame about a generally horizontal axis parallel to the rotational axis of said rearward compaction wheel, for pivotal movement within a vertical plane, and further comprising means connected between said rearward support arm and said main frame for selectively pivoting said rearward support arm to selectively raise and lower said rearward compaction wheel.

5. The compactor of claim 1 wherein said forward support arm is pivotally connected to said main frame about a generally horizontal axis parallel to the rotational axis of said forward compaction wheel, for pivotal movement within a vertical plane, and further comprising means connected between said forward support arm and said frame for selectively pivoting said forward support arm to selectively raise and lower said forward compaction wheel.

6. The compactor of claim 1, further comprising means connected to said forward and rearward compaction wheels for vibrating said forward and rearward compaction wheels.

7. The compactor of claim 1 wherein said first and second diverter wings are selectively pivotally secured about vertical axes to said first and second diverter panels.

8. The compactor of claim 1 wherein first and second hydraulic cylinders are pivotally secured to said first and second diverter wings respectively for pivoting the same with respect to said first and second diverter panels respectively.

9. The compactor of claim 1 wherein said rearward ends of said diverter panels are positioned rearwardly of said rearward compactor wheel.

10. The compactor of claim wherein said first and second diverter panels are substantially vertically disposed and are generally parallel with respect to one another.

* * * * *